United States Patent [19]

Becker

[11] 4,078,308

[45] Mar. 14, 1978

[54] BAND HOLDER AND CUTTER

[76] Inventor: Michael J. Becker, 12140 Anne St., Omaha, Nebr. 68137

[21] Appl. No.: 741,318

[22] Filed: Nov. 12, 1976

[51] Int. Cl.[2] ..... B26B 3/00

[52] U.S. Cl. ..... 30/299; 24/87 R; 30/359; 85/13

[58] Field of Search ..... 30/299, 359, 165; 85/13; 24/87 R

[56] References Cited

U.S. PATENT DOCUMENTS

| | | | |
|---|---|---|---|
| 814,723 | 3/1906 | Nickerson | 24/87 R |
| 971,678 | 10/1910 | Jerolaman | 85/13 |
| 1,953,303 | 4/1934 | Kohlmann | 24/87 R |
| 1,998,610 | 4/1935 | Ellis | 85/13 |
| 2,132,295 | 10/1938 | Hawkins | 85/13 X |
| 2,588,043 | 3/1952 | Rabinowitz et al. | 30/359 |
| 2,612,813 | 10/1952 | Cohn | 85/13 X |

FOREIGN PATENT DOCUMENTS

| | | | |
|---|---|---|---|
| 323,453 | 7/1920 | Germany | 85/13 |

*Primary Examiner*—Donald G. Kelly
*Assistant Examiner*—J. T. Zatarga
*Attorney, Agent, or Firm*—Henderson, Strom & Sturm

[57] ABSTRACT

A band holder and cutter device is defined by a simple L-shaped surface wherein the main leg of the device includes a protruding sharpened, tacking element that can be driven through a strapping band to hold it in place on a packing crate, and the supporting leg of the device supplies a cutting edge to implement the severance and removal of excess banding material when the main leg and the sharpened tacking element are driven into place.

3 Claims, 4 Drawing Figures

BAND HOLDER AND CUTTER

BACKGROUND OF THE INVENTION

This invention relates generally to devices for use in securing and trimming strapping bands as used to construct and secure packing and shipping crates.

The use of strapping bands for the purpose of constructing or strengthening wooden boxes is well known in the prior art, and needs no documentation. At least as far back as 1888, those skilled in the art have appreciated the convenience and security of metal bands equipped with sharp protrusions for piercing the box and affixing the band thereto, as evidenced by U.S. Pat. No. 393,001.

Other devices have been fashioned for application to and direct use with metal strapping band. Such a device is illustrated in U.S. Pat. No. 2,353,140.

A problem arises in connection with the use of such devices, as they merely secure the metal band to the box, and provide no means for cutting the excess banding from the secured banding. Tools for severing strapping are well known in the prior art, but they comprise shears, or the like, which must be provided at the point the banding is secured to the box. This often requires a search by personnel for the proper implement, or at best another operation which must be performed by the agents.

Some devices have been disclosed that both secure the band to a box and cut the band. U.S. Pat. Nos. 3,791,031 and 3,831,280 disclose such devices. These inventions however, are only equipped and designed to sever the band at the point of destination, in order to facilitate unpacking.

The instant invention discloses a device which allows both the band to be secured to the box and the excess banding to be cut away, i.e., two important functions are accomplished substantially simultaneously. It is is borne in mind that such banding is usually stored in bulk, as on a roll, it becomes obvious that this bulk must be separated from the secured material on the box. Where this task is usually accomplished with the aid of shears or some similar implement, the instant invention provides a novel and efficient device which will accomplish not only the later assignment, but will affix the desired banding to the box as well.

SUMMARY OF THE INVENTION

It is therefore an object of this invention to provide a novel device for cutting excess strapping band materials while simultaneously securing the bands to a packing container.

It is a further object of this invention to provide a novel device for the rapid, simple, and efficient cutting of excess strapping bands.

It is a still further object of this invention to provide a novel device for the cutting and securing of strapping bands that is inexpensive to manufacture, durable in use, and of reliable operation.

These and other objects are accomplished by providing a novel L-shaped device wherein the main leg of the "L" includes a protruding, sharpened tacking element that can be driven through a strapping band to hold it in place on a packing crate, and the supporting leg of the L-shaped device supplies a cutting edge to implement the severance and removal of excess banding material when the main leg of the L-shaped device and the sharpened tacking element are driven into place.

BRIEF DESCRIPTION OF THE DRAWINGS

The advantages of this invention will become apparent upon consideration of the following detailed disclosure of the invention, especially when taken on conjunction with the accompanying drawings wherein.

DESCRIPTION OF THE PREFERRED EMBODIMENTS

Tacking devices may be employed to affix strapping bands to shipping crates or other suitable surfaces. This necessitates the utilization of an independent shearing implement to sever and remove the excess banding. If the severing mechanism is appended to the tacking apparatus in the fashion as depicted in FIG. 3, the advantages of the instant invention may be realized.

Figure 1:
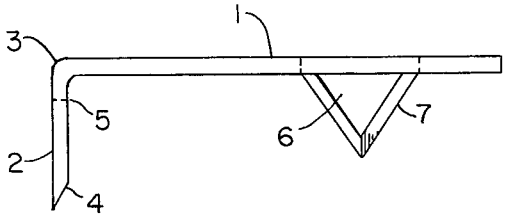
FIG. 1 is a side view of the band holder and cutter device.
Figure 2:
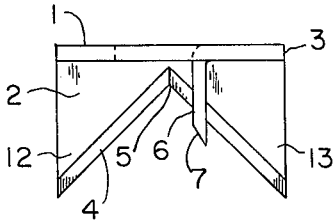
FIG. 2 is a front view of the band holder and cutter device.

Referring now to FIGS. 1 and 2, the basic elements of a preferred embodiment of the inventive device include a base plate 1 attached to a cutting implement 2 at 3. The cutting edge 4 of the cutting implement 2 is formed on a V-shaped notch 5 fashioned from the cutting implement 2, with the vertex of the V-shaped notch 5 located proximate to the base plate 1.

The tacking element 6 is attached to the base plate 1, and protrudes in the same direction as the cutting implement 2. The tacking element 6 is provided with a cutting edge 7 to allow the tacking element 6 more efficient penetration through a strapping band. In FIG. 3 it may be observed that the tacking element 6 is fashioned by cutting through the base plate 1 at 8 and 9, and bending the material at 10 to create the tack as viewed in FIG. 2, the tacking element 6 extends further downward than the vertex of the V-shaped notch 5, but not as far as the cutting implement 2 ultimately extends. The significance of this will be made more apparent below.

Figure 3:
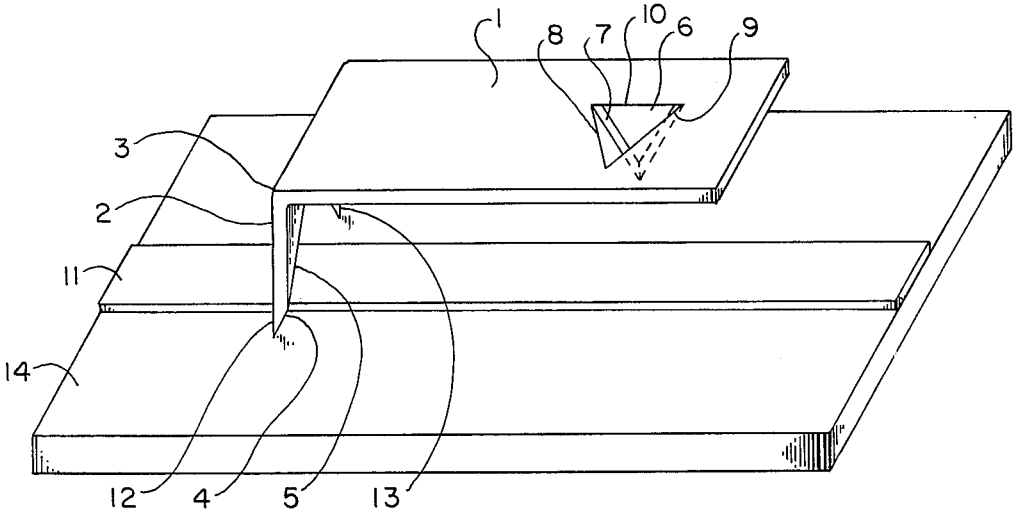
FIG. 3 shows the band holder and cutter device positioned above a metal strapping band.
Figure 4:
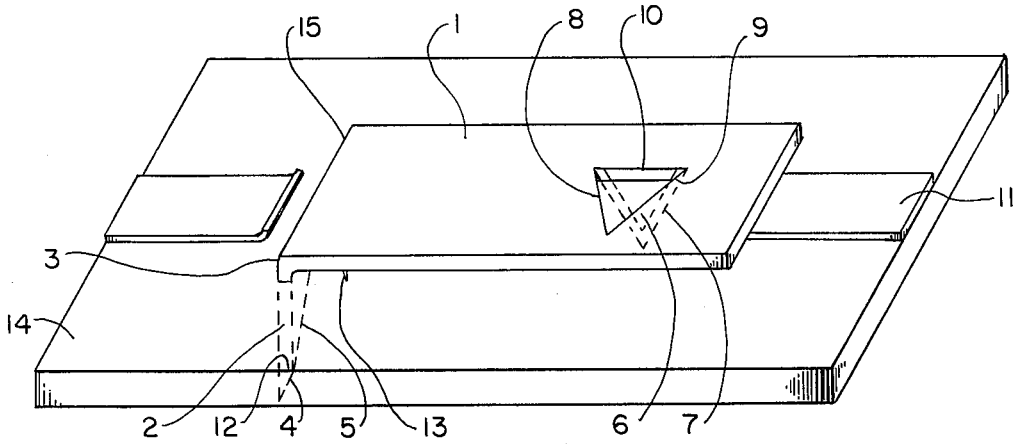
FIG. 4 illustrates the band holder and cutter device after it has been driven into place, severing the excess band and affixing the strapping band to the crate surface.

FIGS. 3 and 4 illustrate the manner of use for the inventive device. Referring to FIG. 3, the strapping band 11 is placed on the surface of the material 14 to which it is desired to attach the band 11. The inventive device is placed over the band 11, with the legs 12 and 13 of the cutting implement 2 straddling the band 11. A force applied to base plate 1 from above, as with a hammer, will project the cutting edge 4 through the strapping band 11, severing the band at 15, as viewed in FIG. 4. With the same stroke, the tacking element 6 will pierce the band 11, and secure band 11 to the material 14.

The unique design of the device is such that the band 11 will be partially severed before it is tacked, since the tacking element 6 is located between the full length of the cutting implement 2.

It is important to note the importance of disposing the tacking element 6 longitudinal to the base plate 1. In this way a band 11 may be secured without substantially weakening the band itself. This is so because the tacking element 6 severs only a small fraction of the band's 6 total width. It should be obvious that many variations of this embodiment will occur to those skilled in the art, and yet not depart from the spirit and scope of this invention. Such variations are intended to be within the scope of the appended claims.

I claim:

1. A strapping band holder and cutter device for the securing of a strapping band to an object, and for the severing of the free end of the strapping band from that portion of the band attached to the object of the device comprising:

(a) a substantially planar member;

(b) a cutting implement having a first end and a second end, said first end attached to said planar member and laterally disposed thereto, and said second end projecting normally from said planar member, said second end including a V-shaped notch disposed therein such that the vertex of said V-shaped notch is proximate said planar member;

(c) a cutting edge formed upon said V-shaped notch; and (d) at least one tacking element having a first end projecting outwardly in the same direction as said cutting implement and a second end attached to said planar member and disposed normal to said cutting implement, said first end projecting outwardly further than the vertex of said V-shaped notch but not as far as the second end of said cutting implement.

2. A strapping band holder and cutter device for the securing of a strapping band to an object as described in claim 1 wherein said tacking element has a cutting edge disposed thereon.

3. A strapping band holder and cutter device for the securing of a strapping band to an object as described in claim 2 wherein said planar member, said cutting implement and said tacking element are integral.

* * * * *